US010665079B2

(12) United States Patent
Vagelos

(10) Patent No.: US 10,665,079 B2
(45) Date of Patent: May 26, 2020

(54) DEVICE, SYSTEM, AND PROCESS FOR AUTOMATIC FALL DETECTION ANALYSIS

(71) Applicant: TracFone Wireless, Inc., Miami, FL (US)

(72) Inventor: Theodore Vagelos, Miami, FL (US)

(73) Assignee: TracFone Wireless, Inc., Miami, FL (US)

( * ) Notice: Subject to any disclaimer, the term of this patent is extended or adjusted under 35 U.S.C. 154(b) by 0 days.

(21) Appl. No.: 15/380,032

(22) Filed: Dec. 15, 2016

(65) Prior Publication Data

US 2017/0169689 A1 Jun. 15, 2017

Related U.S. Application Data

(60) Provisional application No. 62/267,553, filed on Dec. 15, 2015.

(51) Int. Cl.

| | |
|---|---|
| ***G08B 21/04*** | (2006.01) |
| ***G08B 25/01*** | (2006.01) |
| ***G08B 25/10*** | (2006.01) |

(52) U.S. Cl.

CPC ..... *G08B 21/043* (2013.01); *G08B 25/016* (2013.01); *G08B 25/10* (2013.01)

(58) Field of Classification Search

CPC ..... G08B 21/043; G08B 25/016; G08B 25/10
See application file for complete search history.

(56) References Cited

U.S. PATENT DOCUMENTS

| | | | | |
|---|---|---|---|---|
| 6,208,247 | B1 * | 3/2001 | Agre | G01V 1/223 340/13.25 |
| 2013/0065569 | A1 * | 3/2013 | Leipzig | G06F 9/453 455/416 |
| 2013/0214925 | A1 * | 8/2013 | Weiss | G08B 25/001 340/539.11 |
| 2014/0313036 | A1 * | 10/2014 | Sweeney | G08B 21/0446 340/573.1 |
| 2015/0061863 | A1 * | 3/2015 | Barfield, Jr. | G08B 21/0446 340/539.12 |

* cited by examiner

*Primary Examiner* — James J Yang
(74) *Attorney, Agent, or Firm* — BakerHostetler

(57) ABSTRACT

A device and process for optimizing fall detection determined by a wireless device includes receiving with a server potential fall parameter data from a fall detection device associated with a wireless device and analyzing with the server the potential fall parameter data to determine whether the data is consistent with a real fall. The device and process further include sending with the server an alert to the wireless device if the potential fall parameter data is indicative of a real fall and receiving with the server an indication from the wireless device in response to the alert, wherein the indication includes an indication that the potential fall parameter data was one of the following: a real fall or a false positive.

19 Claims, 5 Drawing Sheets

DEVICE, SYSTEM, AND PROCESS FOR AUTOMATIC FALL DETECTION ANALYSIS

CROSS REFERENCE TO PRIOR APPLICATIONS

This application claims the benefit from U.S. Provisional Application No. 62/267,553 filed on Dec. 15, 2015, which is hereby incorporated by reference for all purposes as if fully set forth herein.

BACKGROUND OF THE DISCLOSURE

1. Field of the Disclosure

The disclosure relates to a device, system, and process for automatic fall detection analysis. More particularly, the disclosure relates to a device, system, and process for automatic fall detection analysis having increased accuracy.

2. Related Art

Over two million elderly people in the United States use Personal Emergency Response Systems (PERS) to alert Emergency Response Centers when there is an Emergency. Almost one out of three elderly people fall in their home each year. The "Risk of Falling" and not receiving prompt help is one of the primary reasons given for using a PERS device. Automatic Fall Detection Devices sold today are typically prone to both false positives and false negatives making them appear "unreliable" for the user, the care-giver and their family.

Accordingly, a need exists to provide a device, system, and process for automatic fall detection analysis having increased accuracy.

SUMMARY OF THE DISCLOSURE

The foregoing needs are met, to a great extent, by the disclosure, providing a device, system, and method for providing automatic fall detection analysis having increased accuracy.

According to some aspects of the disclosure, a system for optimizing fall detection determination includes a server configured to receive potential fall parameter data associated with a user from a fall detection device associated with a wireless device, the server is further configured to analyze the potential fall parameter data to determine whether the potential fall parameter data is consistent with a real fall, the server further configured to send an alert to the wireless device if the potential fall parameter data is indicative of a real fall, and the server further configured to receive an indication from the wireless device in response to the alert, wherein the indication includes an indication that the potential fall parameter data was one of the following: a real fall or a false positive.

According to some aspects of the disclosure, a process for optimizing fall detection determination includes receiving with a server potential fall parameter data associated with a user from a fall detection device associated with a wireless device, analyzing with the server the potential fall parameter data to determine whether the potential fall parameter data is consistent with a real fall, sending with the server an alert to the wireless device if the potential fall parameter data is indicative of a real fall, and receiving with the server an indication from the wireless device in response to the alert, wherein the indication includes an indication that the potential fall parameter data was one of the following: a real fall or a false positive.

There has thus been outlined, rather broadly, certain aspect of the disclosure in order that the detailed description thereof herein may be better understood, and in order that the present contribution to the art may be better appreciated. There are, of course, additional aspects of the disclosure that will be described below and which will also form the subject matter of the claims appended hereto.

In this respect, before explaining at least one aspect of the disclosure in detail, it is to be understood that the disclosure is not limited in its application to the details of construction and to the arrangements of the components set forth in the following description or illustrated in the drawings. The disclosure is capable of aspects in addition to those described and of being practiced and carried out in various ways. Also, it is to be understood that the phraseology and terminology employed herein, as well as the abstract, are for the purpose of description and should not be regarded as limiting.

As such those skilled in the art will appreciate that the conception upon which this disclosure is based may readily be utilized as a basis for the designing of other structures, methods and systems for carrying out the several purposes of the disclosure. It is important, therefore, that the claims be regarded as including such equivalent constructions insofar as they do not depart from the spirit and scope of the disclosure.

BRIEF DESCRIPTION OF THE DRAWINGS

The above mentioned features and aspects of the disclosure will become more apparent with reference to the following description taken in conjunction with the accompanying drawings wherein like reference numerals denote like elements and in which.

DETAILED DESCRIPTION

Figure 1:
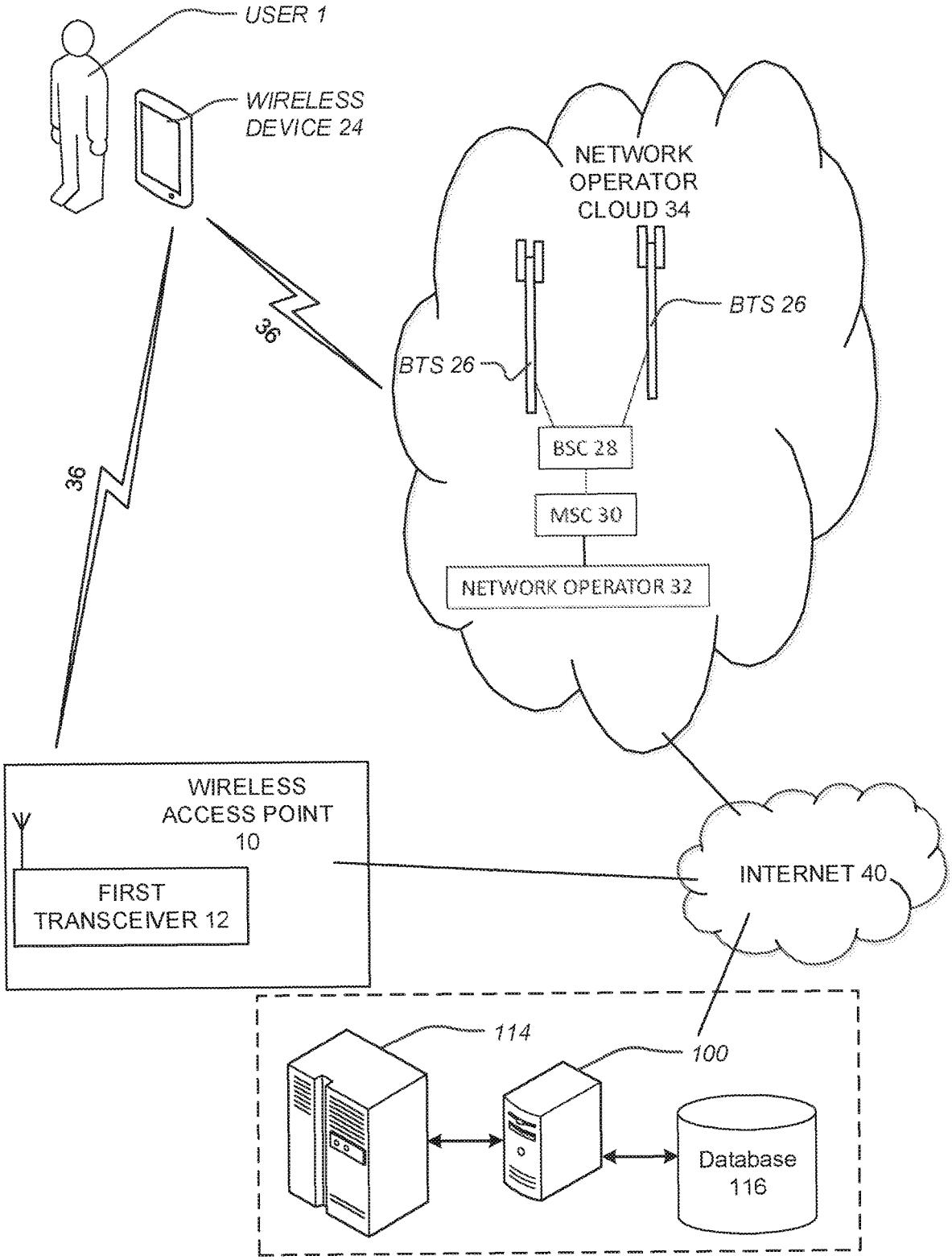
FIG. 1 illustrates an automatic fall detection analysis system having increased accuracy along with associated components, in accordance with aspects of the present disclosure.

As described in further detail below, a wireless device may use a combination of sensory devices including but not limited to a three-axis accelerometer, gyroscope, altitude sensor, and/or like which, when triggered, send readings to a computer that examines the pattern of reading in real-time and determines if an actual fall occurred. A user may be equipped with the wireless device, such as a Personal Emergency Response System dongle that utilizes the above sensors along with a "help" button, a "cancel" button, and an activation alert. When the sensory devices detect what is believed to be a fall, the sensory devices wirelessly send their readings to a computer, such as a cloud-based computer, which analyzes the signal based on past patterns. Since every fall is recorded, the computer may quickly build a library of "real" falls versus false alarms. If the computer determines that there was a fall, the computer sends an alert to the PERS device that communicates and/or sounds the activation alert. If the user fails to silence the alert within a prescribed number of seconds, the computer activates a call to a central station which attempts to call the user. If the user silences the alarm indicating it was a false alarm, the computer will record the event as a false positive.

In this specification and claims it is to be understood that reference to a wireless device is intended to encompass electronic devices such as Personal Emergency Response System (PERS) fall detection devices. Additionally or alternatively, the wireless device may be implemented as mobile phone, tablet computer, MP3 player, personal computer, PDA, and the like. A "wireless device" is intended to encompass any compatible mobile technology computing device that can connect to a wireless communication network, such as PERS fall detection devices, mobile phones, mobile equipment, mobile stations, user equipment, cellular phones, smartphones, handsets, or the like (e.g., Apple iPhone, Google Android based devices, BlackBerry based devices, other types of PDAs or smartphones), wireless dongles, remote alert devices, or other mobile computing devices that may be supported by a wireless network. Wireless devices may connect to a "wireless network" or "network" and are intended to encompass any type of wireless network to obtain or provide PERS services through the use of a wireless device.

Reference in this specification to "one aspect," "an aspect," "other aspects," "one or more aspects" or the like means that a particular feature, structure, or characteristic described in connection with the aspect is included in at least one aspect of the disclosure. The appearances of, for example, the phrase "in one aspect" in various places in the specification are not necessarily all referring to the same aspect, nor are separate or alternative aspects mutually exclusive of other aspects. Moreover, various features are described which may be exhibited by some aspects and not by others. Similarly, various requirements are described which may be requirements for some aspects but not for other aspects.

FIG. 1 illustrates an automatic fall detection analysis system having increased accuracy and associated components, in accordance with aspects of the disclosure. In particular, FIG. 1 shows a wireless device 24, a wireless access point 10, and a network operator cloud 34. The wireless device 24 may be held or carried by the user 1 such as an elderly person, handicapped person, infirm person, person receiving medical care, or the like. As described in detail below, the wireless device 24 is configured to at least determine potential fall events by the user 1 and communicate over a communication channel 36, as defined herein, the potential fall events over a network to a fall analysis computer 100. The network may include the network operator cloud 34, the Internet 40, a network associated with the wireless access point 10 and/or other networks. Only one network is necessary for operation of the wireless device 24. However, multiple networks are contemplated as well to provide better coverage.

The network operator cloud 34 may include a base transceiver station 26 (BTS), a base station controller 28 (BSC), and a mobile switching center 30 (MSC) overseen by a network operator 32. Other types of wireless networks utilizing a communication channel as defined herein are contemplated as well. The network operator cloud 34 may communicate with the wireless device 24 over a communication channel 36 as defined herein. The network operator cloud 34 may further communicate over the Internet 40 to the fall analysis computer 100. The use of the network operator cloud 34 may be beneficial to the user 1 as there are limited geographical limitations. Anywhere the user 1 goes where there is access to the network operator cloud 34 will provide the user 1 with fall detection analysis and help.

The wireless access point 10 may include a first transceiver 12, a second transceiver for connecting to the Internet 40, a computer readable medium, a processor, a random access memory, and a read-only memory. The first transceiver 12 can include, for example, a wireless antenna and associated circuitry capable of data transmission with the wireless device 24. In one aspect of the disclosure, the first transceiver 12 may receive from the wireless device 24, for example, a request to send data to the fall analysis computer 100. The first transceiver 12 may receive this request in a modulated signal. The first transceiver 12 then may demodulate this signal for further operation within the wireless access point 10. The second transceiver formats this message into a protocol appropriate for transmitting data, for example, via a bus on the wireless access point 10. The second transceiver receives this message and modulates the message for transmission over the Internet 40 to the fall analysis computer 100.

The fall analysis computer 100 may be associated with and in communication with a database 116 and a server 114. The fall analysis computer 100 may be configured to receive potential fall event data from the wireless device 24, analyze the potential fall event data from the wireless device 24 and store the potential fall event data to a library in the database 116, communicate with the wireless device 24, and communicate with emergency services as needed. The fall analysis computer 100 may be configured as a cloud-based computer system.

Figure 2:
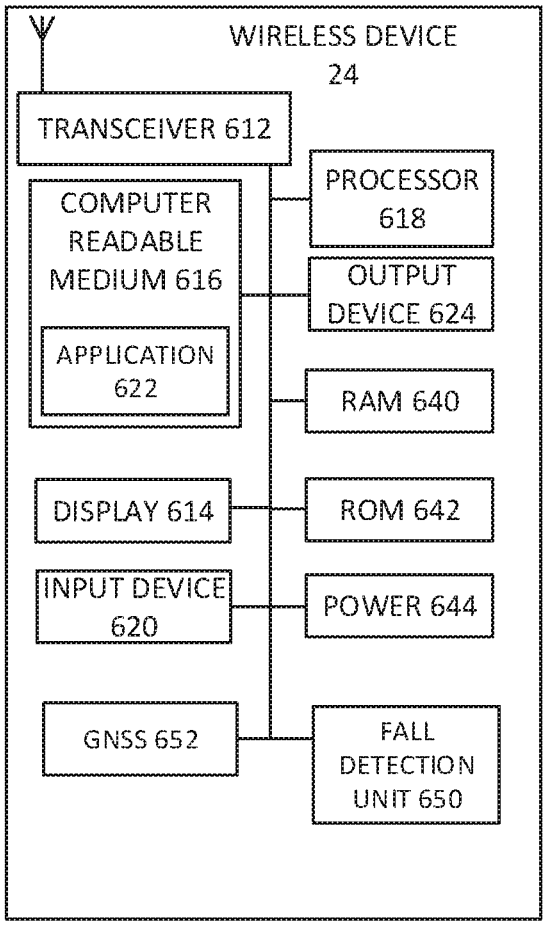
FIG. 2 illustrates a wireless device that may connect with a network to provide automatic fall detection analysis having increased accuracy, in accordance with aspects of the present disclosure.

FIG. 2 illustrates a wireless device that may connect with a network to provide automatic fall detection analysis having increased accuracy, in accordance with aspects of the present disclosure. In particular, FIG. 2 illustrates an exemplary wireless device 24 and its potential components. The wireless device 24 may include a transceiver 612, a display 614, a computer readable medium 616, a processor 618, and an application 622. The transceiver 612 can include, for example, a wireless antenna and associated circuitry capable of data transmission over a communication channel as defined herein. The transceiver 612 may transmit and receive data over the data transmission protocol.

The wireless device 24 may include a fall detection unit 650. The fall detection unit 650 may include one or more sensors to detect a fall by the user 1. The fall detection unit 650 may be implemented by any one of accelerometers, gyroscopes, altitude sensors, and the like. The fall detection unit 650 may further include analog-to-digital converters, filters, and the like to process the signals associated with any of the sensors. The data associated with a potential fall sent by the fall detection unit 650 may be forwarded to the processor 618 in conjunction with the application 622. Thereafter, the transceiver 612 may communicate the data associated with a potential fall over a network to the fall analysis computer 100. The application 622 may implement various aspects of the disclosure including the graphical user interface illustrated in FIG. 3 and the fall detection process 400 illustrated in FIGS. 4 and 5.

The display 614 of the wireless device 24 can be configured to display various information provided to the display 614 from the processor 618 of the wireless device 24, computer readable medium 616, and/or application 622. The screen may be a light-emitting diode display (LED), an electroluminescent display (ELD), a plasma display panel (PDP), a liquid crystal display (LCD), an organic light-emitting diode display (OLED), or any other display technology.

The displayed information can include, for example, the network connection strength, the type of mobile network data connection (such as 3G, 4G LTE, 5G, EVDO, etc.) the wireless device 24 is connected to, and/or other information potentially useful to the user. The information may be displayed simultaneously or the user may interact with an input device such as buttons on the wireless device 24 or, if the display 614 is a touch-screen, with the icons on the display 614 to cycle through the various types of information for display.

The computer readable medium 616 may be configured to store the application 622. For the purposes of this disclosure, computer readable medium 616 stores computer data, which may include computer program code that may be executable by the processor 618 of the wireless device 24 in machine readable form. By way of example, and not limitation, the computer readable medium 616 may include computer readable storage media, for example tangible or fixed storage of data, or communication media for transient interpretation of code-containing signals. Computer readable storage media, as used herein, refers to physical or tangible storage (as opposed to signals) and includes without limitation volatile and non-volatile, removable and non-removable storage media implemented in any method or technology for the tangible storage of information such as computer-readable instructions, data structures, program modules, or other data. In one or more aspects, the actions and/or events of a method, algorithm, or module may reside as one or any combination or set of codes and/or instructions on a computer readable medium 616 or machine readable medium, which may be incorporated into a computer program product.

The processor 618 may be configured to execute the application 622. The processor 618 can be, for example, dedicated hardware as defined herein, a computing device, a microprocessor, a central processing unit (CPU), a programmable logic array (PLA), a programmable array logic (PAL), a generic array logic (GAL), a complex programmable logic device (CPLD), an application-specific integrated circuit (ASIC), a field-programmable gate array (FPGA), or any other programmable logic device (PLD) configurable to execute the application 622.

The wireless device 24 may also have a power supply 644. The power supply 644 may be a battery such as nickel cadmium, nickel metal hydride, lead acid, lithium ion, lithium ion polymer, and the like. The wireless device 24 may also include a memory 640, which could be internal memory or a removable storage type such as a memory chip. The wireless device 24 may also include a read only memory (ROM) 642. The memory 640 may store information about the wireless device 24, including profiles and settings. Another information storage type that the wireless device 24 may use is a subscriber identity module (SIM). Additionally, the wireless device 24 may include an audio input device 620 configured to receive verbal commands, verbal instructions, verbal questions, and the like. Additionally, the wireless device 24 may include an audio output device 624 configured to output sounds including commands, verbal instructions, verbal questions, alerts and the like.

According to another aspect of the disclosure, the wireless device 24 and/or the fall analysis computer 100 may estimate the location of the wireless device 24 based, at least in part, on a global navigation satellite system (GNSS 652). In another aspect, a network operator cloud 34 may secure location determination based on a specific cell in which the wireless device 24 connects. In yet another aspect, a network operator cloud 34 may obtain location determination based on triangulation with respect to a plurality of cells in which the wireless device 24 receives signals.

Figure 3:
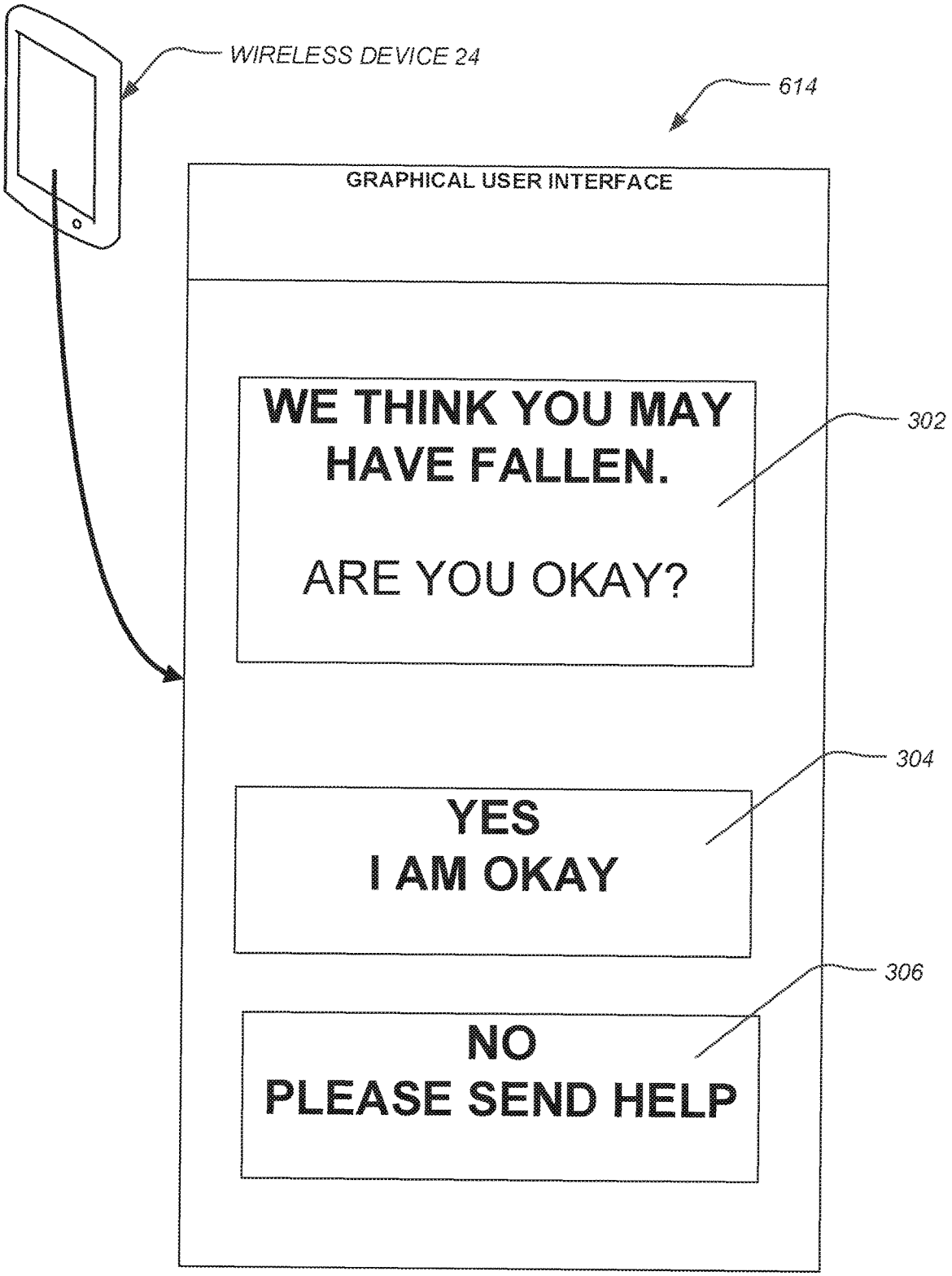
FIG. 3 illustrates a graphical user interface for a wireless device, in accordance with aspects of the present disclosure.

FIG. 3 illustrates a graphical user interface for a wireless device, in accordance with aspects of the present disclosure. In particular, the display 614 may generate a graphical user interface. When the wireless device 24 and/or the fall analysis computer 100 determines that there has been a potential fall by the user 1, the graphical user interface may provide an indication 302. The indication 302 may indicate a question: "WE THINK YOU MAY HAVE FALLEN. ARE YOU OKAY?" The display 614 and associated graphical user interface may further provide touch sensitive buttons 304, 306 for providing responses to the question. The touch sensitive button 304 may provide an indication of "YES I AM OKAY." The touch sensitive button 306 may provide an indication of "NO PLEASE SEND HELP." Of course the question and responsive indications are simply exemplary. Other similar language is contemplated as well. Moreover, during setup of the wireless device 24, languages may be set such that the indications are in a desired language preferred by the user 1. Alternatively, the buttons 304, 306 may be implemented as non-touch sensitive buttons with text preprinted thereon such as: "help," "cancel," or the like. Alternatively or additionally, the audio output device 624 may emit the indication 302 verbally. Alternatively or additionally, the indication 302 may be an alert sound. Alternatively, the wireless device 24 and application 622 may be implemented to receive vocal responses such as: "help," "yes I am okay," "please send help," and the like.

Figure 4:
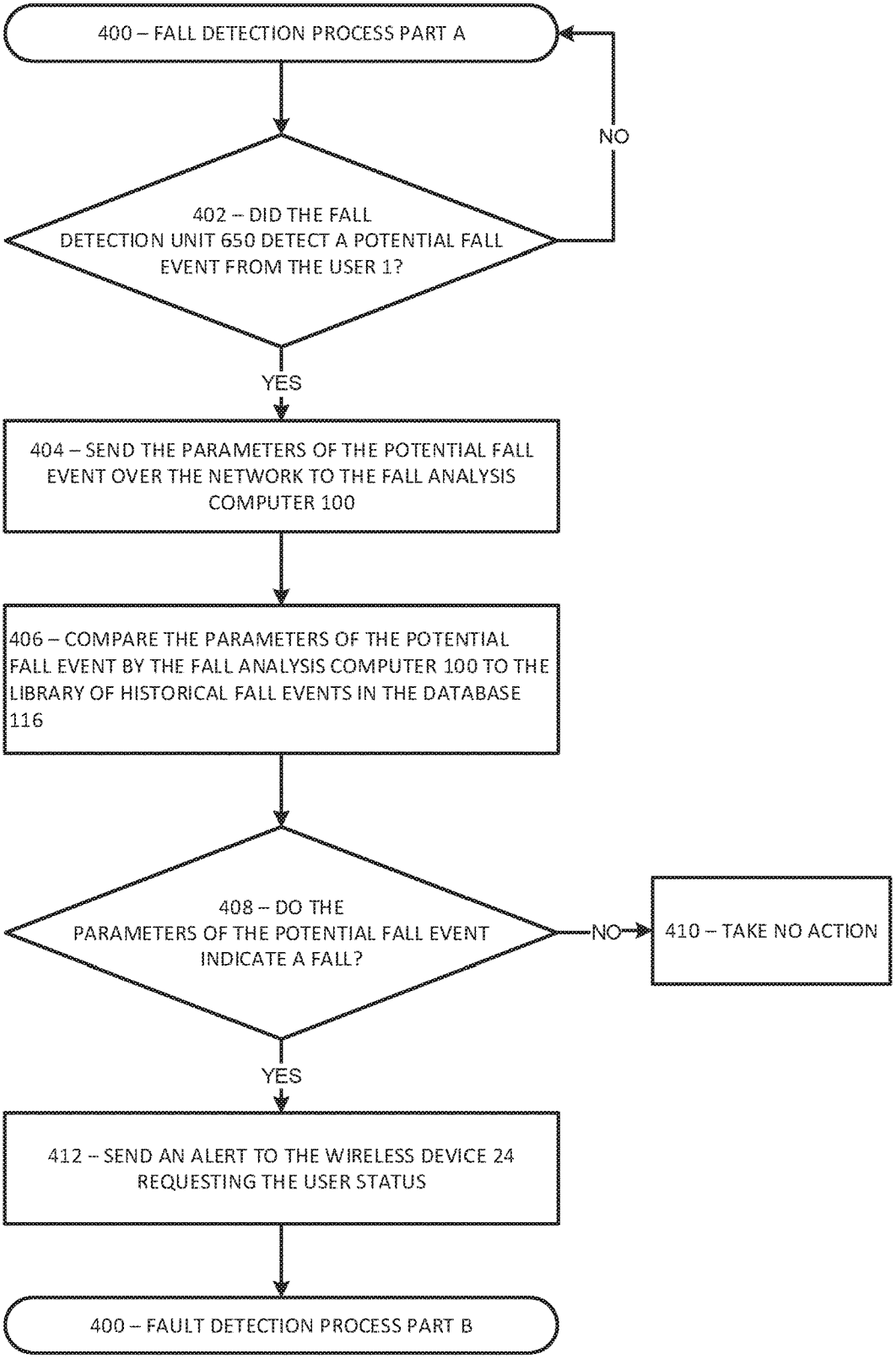
FIG. 4 illustrates a process for automatic fall detection analysis having increased accuracy, in accordance with aspects of the present disclosure.

FIG. 4 illustrates a process for automatic fall detection analysis having increased accuracy, in accordance with aspects of the present disclosure. In particular, FIG. 4 illustrates a fall detection process 400 (part A). The fall detection process 400 may first determine in box 402 whether the fall detection unit 650 has detected a potential fall event of the user 1. Should the fall detection unit 650 determine a potential fall event of the user 1, as shown in box 404, the wireless device 24 may send the parameters of the potential fall event over the network to the fall analysis computer 100. The parameters may include acceleration in each axis sensed by the wireless device 24, the change in altitude sensed by the wireless device 24, the movements of the wireless device 24 sensed by a gyroscope thereof, the location of the wireless device 24, and the like.

As shown in box 406, the fall analysis computer 100 may compare the parameters of the potential fall event to a library of previous potential fall events in the database 116. Next, as shown in box 408, the fall analysis computer 100 may determine whether the parameters of the potential fall event indicate a real fall. This determination may be made by comparison and analysis of the library of previous detected fall events and the subsequent outcomes of these fall events. For example, the parameters associated with each previous potential fall event are stored in the library of the database 116. Moreover, the library in the database 116 may further include the associated response by the user 1 for each of the previous potential fall events. In this regard, the various detected accelerations and other parameters of previous fall events have been stored in the library of the database 116 along with whether the potential fall was a fall event, a non-fall event, a false positive, a false negative and/or the like to provide a historical account that allows the fall analysis computer 100 to determine future events more accurately. In one aspect, the fall analysis computer 100 may use statistical analysis based on the parameters to determine a real fall. In other aspects, the fallen analysis computer 100 may utilize a neural network, artificial intelligence, and/or the like on the parameters to determine a real fall.

If the parameters associated with the potential fall event are determined to not be consistent with a fall (NO), then the fall analysis computer 100 may determine there was no fall and take no action as indicated in box 410. On the other hand, if the parameters of the potential fall event indicate a likelihood that the user has fallen, then the fall analysis computer 100 may send an alert to the wireless device 24 requesting the user status as shown in box 412. This alert may include the indication 302, which may be a visual indication, a verbal indication, a sound alert, or the like.

Figure 5:
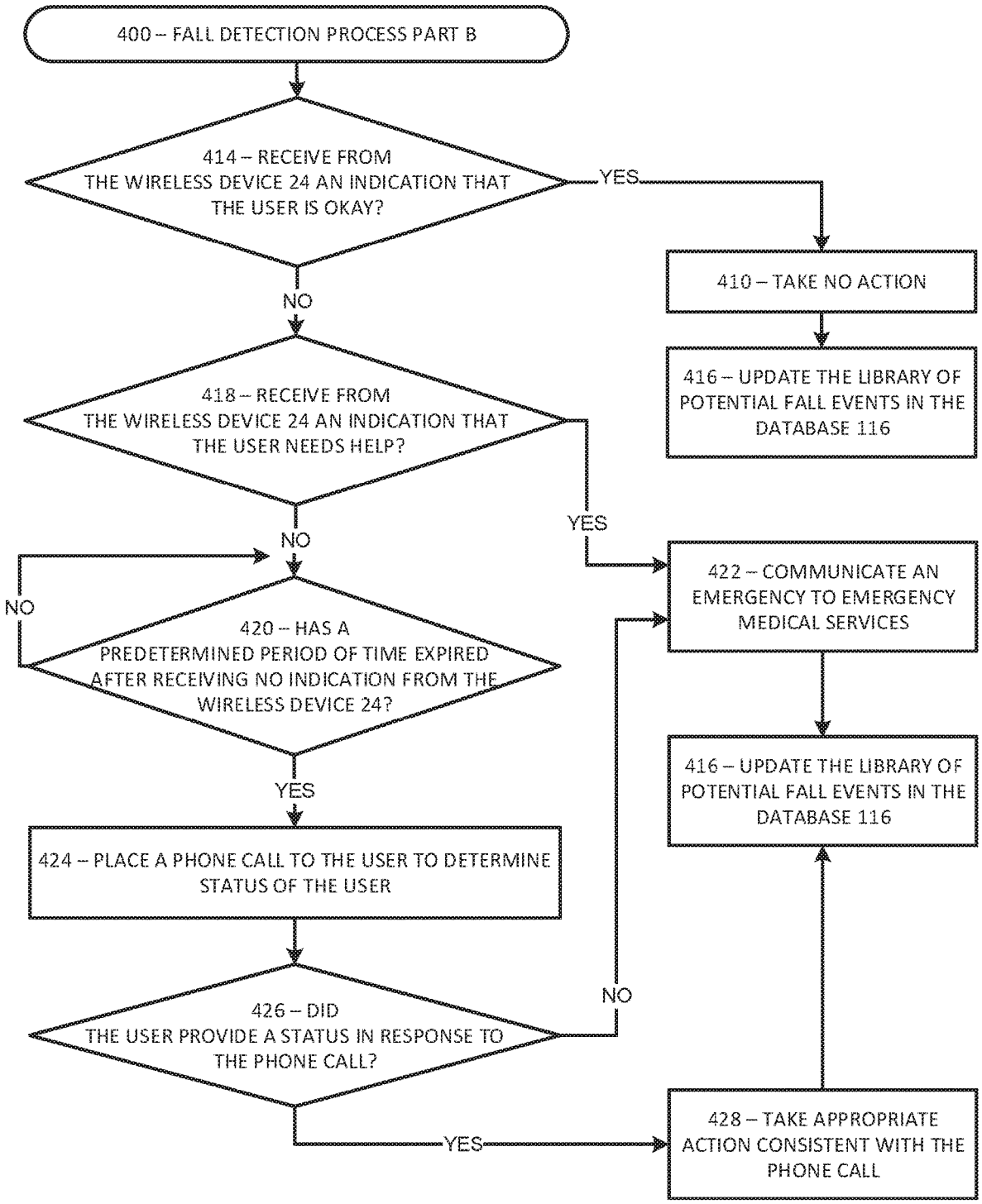
FIG. 5 illustrates a further process for automatic fall detection analysis having increased accuracy, in accordance with aspects of the present disclosure.

FIG. 5 illustrates a further process for automatic fall detection analysis having increased accuracy, in accordance with aspects of the present disclosure. In particular, FIG. 5 illustrates the fall detection process 400 (part B). In box 414, the fall analysis computer 100 may receive from the wireless device 24 an indication that the user is okay. For example, the user 1 may press the indication 304 indicating that they are okay. Thereafter, in box 416, the fall analysis computer may update the library of potential fall events in the database 116 with the fall parameters and associated outcome of the user 1 being okay as a false positive.

On the other hand, in response to the indication 302, as shown in box 418, the fall analysis computer 100 may receive from the wireless device 24 an indication that the user needs help. In response to this indication, as shown in box 422, the fall analysis computer may communicate an emergency to emergency medical services. In this regard, included with the fall parameters, the location of the user 1 may be transmitted to the fall analysis computer 100 as well. This information may be communicated to emergency medical services in order to assist the user 1.

On the other hand, as shown in box 420, if there is no response from the user 1, the fall analysis computer may determine whether a predetermined period of time has expired after receiving no indication from the wireless device 24. The predetermined time may be a few seconds to several minutes. The predetermined time may also be set by the user. In this case, the fall analysis computer 100 may place a phone call to the user to determine status of the user as shown in box 424. This may be an automated phone call by the fall analysis computer 100 with interactive voice recognition capabilities. Alternatively, the phone call may be made by a person in response to a notice from the fall analysis computer 100 such as a text message, computer notification, e-mail, and/or the like. The person may be a family member, an employee of the Emergency Response Center, or the like.

Thereafter, as shown in box 426 it is determined whether the user 1 provided a status in response to the phone call. If the fall analysis computer 100 places an automated phone call, an associated interactive voice response system may determine the status of the user 1 and take appropriate action 428. The appropriate action may include communicating with emergency medical services, receiving an indication that the fall was a false positive, or the like. Thereafter the library may be updated consistent with box 416. If a person places the phone call to the user 1, the person may update the fall analysis computer 100 regarding the fall events consistent with box 416. If the phone call is not answered by the user 1, the fall analysis computer 100 may automatically place a phone call to emergency medical services as shown in box 422.

Accordingly, as described above the disclosure provides for a wireless device that may use a combination of sensory devices that send their readings to a computer that examines the pattern in real-time and determines if an actual fall occurred. The computer analyzes the signals based on past patterns. Since every fall is recorded, the computer may quickly build a library of "real" falls versus false alarms. Thus, the disclosure provides a device, system, and process for automatic fall detection analysis having increased accuracy.

Further in accordance with various aspects of the disclosure, the methods described herein are intended for operation with dedicated hardware implementations including, but not limited to PCs, PDAs, SIM cards, semiconductors, application specific integrated circuits (ASIC), programmable logic arrays, cloud computing devices, and other hardware devices constructed to implement the methods described herein.

Additionally, the various aspects of the disclosure may be implemented in a non-generic computer implementation. Moreover, the various aspects of the disclosure set forth herein improve the functioning of the system as is apparent from the disclosure hereof. Furthermore, the various aspects of the disclosure involve computer hardware that it specifically programmed to solve the complex problem addressed by the disclosure. Accordingly, the various aspects of the disclosure improve the functioning of the system overall in its specific implementation to perform the process set forth by the disclosure and as defined by the claims.

According to an example, the global navigation satellite system (GNSS 652) may include a device and/or system that may estimate its location based, at least in part, on signals received from space vehicles (SVs). In particular, such a device and/or system may obtain "pseudorange" measurements including approximations of distances between associated SVs and a navigation satellite receiver. In a particular example, such a pseudorange may be determined at a receiver that is capable of processing signals from one or more SVs as part of a Satellite Positioning System (SPS). Such an SPS may include, for example, a Global Positioning System (GPS), Galileo, Glonass, to name a few, or any SPS developed in the future. To determine its location, a satellite navigation receiver may obtain pseudorange measurements to three or more satellites as well as their positions at time of transmitting. Knowing the SV orbital parameters, these positions can be calculated for any point in time. A pseudorange measurement may then be determined based, at least in part, on the time a signal travels from an SV to the receiver, multiplied by the speed of light. While techniques described herein may be provided as implementations of location determination in GPS and/or Galileo types of SPS as specific illustrations according to particular examples, it should be understood that these techniques may also apply to other types of SPS, and that claimed subject matter is not limited in this respect.

Aspects of the disclosure may include a server 114 executing an instance of an application or software configured to accept requests from a client and giving responses accordingly. The server may run on any computer including dedicated computers. The computer may include at least one processing element, typically a central processing unit (CPU), and some form of memory. The processing element may carry out arithmetic and logic operations, and a sequencing and control unit may change the order of operations in response to stored information. The server may include peripheral devices that may allow information to be retrieved from an external source, and the result of operations saved and retrieved. The server may operate within a client-server architecture. The server may perform some tasks on behalf of clients. The clients may connect to the server through the network on a communication channel as defined herein. The server may use memory with error detection and correction, redundant disks, redundant power supplies and so on.

The disclosure may include communication channels 36 that may be any type of wired or wireless electronic communications network, such as, e.g., a wired/wireless local area network (LAN), a wired/wireless personal area network (PAN), a wired/wireless home area network (HAN), a wired/wireless wide area network (WAN), a campus network, a metropolitan network, an enterprise private network, a virtual private network (VPN), an internetwork, a backbone network (BBN), a global area network (GAN), the Internet, an intranet, an extranet, an overlay network, a cellular telephone network, a Personal Communications Service (PCS), using known protocols such as the Global System for Mobile Communications (GSM), CDMA (Code-Division Multiple Access), W-CDMA (Wideband Code-Division Multiple Access), Wireless Fidelity (Wi-Fi), Bluetooth, 4G (fourth generation mobile telecommunications technology), Long Term Evolution (LTE), 5G (5th generation mobile networks or 5th generation wireless systems), EVolution-Data Optimized (EVDO) and/or the like, and/or a combination of two or more thereof.

The disclosure may be implemented in any type of computing devices or processor, such as, e.g., a desktop computer, personal computer, a laptop/mobile computer, a personal data assistant (PDA), a mobile phone, a tablet computer, cloud computing device, and the like, with wired/wireless communications capabilities via the communication channels 220.

In an aspect, the disclosure may be implemented in any type of mobile smartphones that are operated by any type of advanced mobile data processing and communication operating system, such as, e.g., an Apple™ iOS™ operating system, a Google™ Android™ operating system, a RIM™ Blackberry™ operating system, a Nokia™ Symbian™ operating system, a Microsoft™ Windows Mobile™ operating system, a Microsoft™ Windows Phone™ operating system, a Linux™ operating system or the like.

The application described in the disclosure may be implemented to execute on a processor. The processor also executing an Apple™ iOS™ operating system, a Google™ Android™ operating system, a RIM™ Blackberry™ operating system, a Nokia™ Symbian™ operating system, a Microsoft™ Windows Mobile™ operating system, a Microsoft™ Windows Phone™ operating system, a Linux™ operating system or the like. The application may be displayed as an icon. The application may have been downloaded from the Internet, pre-installed, or the like. In some aspects, the application may be obtained from Google Play™, Android Market™, Apple Store™, or the like digital distribution source. The application may be written in conjunction with the software developers kit (SDK) associated with an Apple™ iOS™ operating system, a Google™ Android™ operating system, a RIM™ Blackberry™ operating system, a Nokia™ Symbian™ operating system, a Microsoft™ Windows Mobile™ operating system, a Microsoft™ Windows Phone™ operating system, a Linux™ operating system or the like.

It should also be noted that the software implementations of the disclosure as described herein are optionally stored on a tangible storage medium, such as: a magnetic medium such as a disk or tape; a magneto-optical or optical medium such as a disk; or a solid state medium such as a memory card or other package that houses one or more read-only (non-volatile) memories, random access memories, or other re-writable (volatile) memories. A digital file attachment to email or other self-contained information archive or set of archives is considered a distribution medium equivalent to a tangible storage medium. Accordingly, the disclosure is considered to include a tangible storage medium or distribution medium, as listed herein and including art-recognized equivalents and successor media, in which the software implementations herein are stored.

While the device, system, and method have been described in terms of what are presently considered to be specific aspects, the disclosure need not be limited to the disclosed aspects. It is intended to cover various modifications and similar arrangements included within the spirit and scope of the claims, the scope of which should be accorded the broadest interpretation so as to encompass all such modifications and similar structures. The present disclosure includes any and all aspects of the following claims.

The invention claimed is:

1. A system for optimizing fall detection determination, the system comprising:

a server configured to receive potential fall parameter data associated with a user from a fall detection device associated with a wireless device, the wireless device implementing a three-axis accelerometer, a gyroscope, and an altitude sensor, the potential fall parameter data comprising 3-axis acceleration data, gyroscopic data, and altitude data received from the wireless device implementing the three-axis accelerometer, the gyroscope, and the altitude sensor;

a database associated with and in communication with the server, the database configured to store the potential fall parameter data of the user, and the database further configured to store a library of previous potential fall parameter data of the user;

the server further configured to analyze the potential fall parameter data to determine whether the potential fall parameter data is consistent with a real fall, wherein the server analyzes the potential fall parameter data and compares the potential fall parameter data comprising the 3-axis acceleration data, the gyroscopic data, and the altitude data to the library of previous potential fall parameter data utilizing artificial intelligence to determine whether the potential fall parameter data is consistent with a real fall;

the server further configured to send an alert to the wireless device if the potential fall parameter data is indicative of a real fall based on the comparison of the potential fall parameter data comprising the 3-axis acceleration data, the gyroscopic data, and the altitude data to the library of previous fall parameter data utilizing the artificial intelligence;

the server further configured to receive an indication from the wireless device in response to the alert, wherein the indication includes an indication that the potential fall parameter data was one of the following: a real fall or a false positive;

the server further configured to receive an indication from the wireless device in response to the alert requesting help;

the server further configured to receive a location of the user in response to the indication from the wireless device requesting help; and the server further configured to transmit the location of the user and the potential fall parameter data to emergency medical services in response to the indication from the wireless device requesting help, wherein the server communicates to the wireless device over a wireless network that comprises a wireless mobile telecommunications network; and wherein the server is configured to estimate the location of the wireless device based on a global navigation satellite system;

wherein the wireless device comprises a smartphone and the smartphone implements the three-axis accelerometer, the gyroscope, and the altitude sensor to obtain the potential fall parameter data; and wherein the smartphone includes at least one analog-to-digital converter and at least one filter configured to process signals associated with the three-axis accelerometer, the gyroscope, and the altitude sensor to obtain the potential fall parameter data.

2. The system according to claim 1 further comprising an interactive voice response system configured to place an automated phone call to the wireless device a predetermined time after sending the alert when no indication is received from the wireless device, the interactive voice response system configured with interactive voice recognition capabilities, wherein the predetermined time is set by the user;

wherein the alert comprises an alert sound generated by an audio output device implemented by the smartphone.

3. The system according to claim 1 further comprising an interactive voice response system configured to place an automated phone call to the wireless device a predetermined time after sending the alert when no indication is received from the wireless device, the interactive voice response system configured with interactive voice recognition capabilities, wherein the smartphone implements a fall detection application downloaded from an application store; and wherein the alert comprises an alert message generated by a graphical user interface implemented by the smartphone.

4. The system according to claim 1 further comprising an interactive voice response system configured to place an automated phone call to the wireless device a predetermined time after sending the alert when no indication is received from the wireless device, the interactive voice response system configured with interactive voice recognition capabilities, wherein the smartphone implements the three-axis accelerometer, the gyroscope, and the altitude sensor.

5. The system according to claim 1 further comprising an interactive voice response system configured to place an automated phone call to the wireless device a predetermined time after sending the alert when no indication is received from the wireless device, the interactive voice response system configured with interactive voice recognition capabilities, wherein the indication from the user comprises a verbal response received by an audio input device configured to receive verbal input and associated with and implemented by the smartphone.

6. The system according to claim 1 wherein the indication from the user comprises an input selection response to a touch screen having a graphical user interface associated with the smartphone and received by the smartphone.

7. The system according to claim 1 wherein the server analyzes the potential fall parameter data comprising the 3-axis acceleration data, the gyroscopic data, and the altitude data and compares the potential fall parameter data to the library of previous fall parameter data comprising previous detected fall events, subsequent outcomes of the previous fall events that include an associated response by the user for each of the previous potential fall parameter data, various detected accelerations, and whether the potential fall was a fall event, a non-fall event, a false positive, or a false negative.

8. The system according to claim 1 further comprising an interactive voice response system configured to place an automated phone call to the wireless device a predetermined time after sending the alert when no indication is received from the wireless device, the interactive voice response system configured with interactive voice recognition capabilities, wherein the potential fall parameter data is generated by the fall detection device associated with the smartphone.

9. The system of claim 1, wherein the smartphone comprises:

a fall detection unit configured to generate the potential fall parameter data;

the fall detection device implementing the three-axis accelerometer, the gyroscope, and the altitude sensor to obtain the potential fall parameter data;

a transceiver configured to transmit potential fall parameter data comprising the 3-axis acceleration data, the gyroscopic data, and the altitude data over the wireless mobile telecommunications network to the server;

an output device configured to receive and output the alert in at least one of the following: a graphical user interface and an audio output device;

an input device configured to receive an input response from the user, the input device comprising at least one of the following: a touchscreen graphical user interface implemented by the smartphone and an audio input device implemented by the smartphone configured to receive verbal input; and the at least one analog-to-digital converter and the at least one filter configured to process signals associated with the three-axis accelerometer, the gyroscope, and the altitude sensor to obtain the potential fall parameter data, wherein the smartphone implements a fall detection application downloaded from an application store.

10. A process for optimizing fall detection determination, the process comprising:

receiving with a server potential fall parameter data associated with a user from a fall detection device associated with a wireless device, the wireless device implementing a three-axis accelerometer, a gyroscope, and an altitude sensor, the receiving comprises receiving over a wireless network that comprises a wireless mobile telecommunications network, the potential fall parameter data comprising 3-axis acceleration data, gyroscopic data, and altitude data received from the wireless device implementing the three-axis accelerometer, the gyroscope, and the altitude sensor;

storing in a database associated with and in communication with the server the potential fall parameter data of the user, and the database further storing a library of previous potential fall parameter data of the user;

analyzing with the server the potential fall parameter data to determine whether the potential fall parameter data is consistent with a real fall, wherein the server analyzes the potential fall parameter data and compares the potential fall parameter data comprising the 3-axis acceleration data, the gyroscopic data, and the altitude data to the library of previous fall parameter data utilizing artificial intelligence to determine whether the potential fall parameter data is consistent with a real fall;

sending with the server an alert to the wireless device if the potential fall parameter data is indicative of a real fall based on the comparison of the potential fall parameter data comprising the 3-axis acceleration data, the gyroscopic data, and the altitude data to the library of previous fall parameter data utilizing the artificial intelligence; and receiving with the server an indication from the wireless device in response to the alert, wherein the indication includes an indication that the potential fall parameter data was one of the following: a real fall or a false positive;

receiving with the server further an indication from the wireless device in response to the alert requesting help;

receiving with the server a location of the user in response to the indication from the wireless device requesting help; and transmitting with the server the location of the user and the potential fall parameter data to emergency medical services in response to the indication from the wireless device requesting help, wherein the server is configured to estimate a location of the wireless device based on a global navigation satellite system;

wherein the wireless device comprises a smartphone and the fall detection device implements the three-axis accelerometer, the gyroscope, and the altitude sensor to obtain the potential fall parameter data; and wherein the smartphone includes at least one analog-to-digital converter and at least one filter configured to process signals associated with the three-axis accelerometer, the gyroscope, and the altitude sensor to obtain the potential fall parameter data.

11. The process according to claim 10 further comprising placing an automated phone call with an interactive voice response system to the wireless device a predetermined time after sending the alert when no indication is received from the wireless device, the interactive voice response system configured with interactive voice recognition capabilities, wherein the predetermined time is set by the user; and wherein the alert comprises an alert sound generated by an audio output device implemented by the smartphone.

12. The process according to claim 10 further comprising placing an automated phone call with an interactive voice response system to the wireless device a predetermined time after sending the alert when no indication is received from the wireless device, the interactive voice response system configured with interactive voice recognition capabilities, wherein the smartphone implements a fall detection application downloaded from an application store;

wherein the alert comprises an alert message generated in at least one of the following: a graphical user interface implemented by the smartphone and an audio output device implemented by the smartphone.

13. The process according to claim 10 further comprising placing an automated phone call with an interactive voice response system to the wireless device a predetermined time after sending the alert when no indication is received from the wireless device, the interactive voice response system configured with interactive voice recognition capabilities, wherein the fall detection device comprises the three-axis accelerometer, the gyroscope, and the altitude sensor implemented by the smartphone.

14. The process according to claim 10 further comprising placing an automated phone call with an interactive voice response system to the wireless device a predetermined time after sending the alert when no indication is received from the wireless device, the interactive voice response system configured with interactive voice recognition capabilities, wherein the indication from the user comprises a verbal response received by an audio input device associated with and implemented by the smartphone.

15. The process according to claim 10 wherein the indication from the user comprises an input selection response to a touch screen having a graphical user interface associated with the smartphone and received by the smartphone.

16. The process according to claim 10 further comprising:

analyzing with the server the potential fall parameter data comprising the 3-axis acceleration data, the gyroscopic data, and the altitude data; and comparing the potential fall parameter data comprising the 3-axis acceleration data, the gyroscopic data, and the altitude data to the library of previous fall parameter data comprising previous detected fall events, subsequent outcomes of the previous fall events that include an associated response by the user for each of the previous potential fall parameter data, various detected accelerations, and whether the potential fall was a fall event, a non-fall event, a false positive, or a false negative.

17. The process according to claim 10 further comprising placing an automated phone call with an interactive voice response system to the wireless device a predetermined time after sending the alert when no indication is received from the wireless device, the interactive voice response system configured with interactive voice recognition capabilities, wherein the potential fall parameter data is generated by the fall detection device associated with the smartphone.

18. The process of claim 10, further comprising:

generating with a fall detection unit the potential fall parameter data with the smartphone, the fall detection device implementing the three-axis accelerometer, the gyroscope, and the altitude sensor;

processing signals associated with the three-axis accelerometer, the gyroscope, and the altitude sensor with the at least one analog-to-digital converter and at least one filter to obtain the potential fall parameter data; and transmitting with a transceiver the potential fall parameter data over the wireless mobile telecommunications network to the server with the smartphone;

outputting with an output device the alert with the smartphone, the output device configured to receive and output the alert in at least one of the following: a graphical user interface and an audio output device; and receiving with an input device an input response from the user with the smartphone, the input device comprising at least one of the following: a touchscreen graphical user interface implemented by the smartphone and an audio input device configured to receive verbal input that is implemented by the smartphone, wherein the smartphone implements a fall detection application downloaded from an application store.

19. A system for optimizing fall detection determination, the system comprising:

a server configured to receive potential fall parameter data associated with a user from a fall detection device associated with a wireless device, the wireless device implementing a three-axis accelerometer, a gyroscope, and an altitude sensor, the potential fall parameter data comprising 3-axis acceleration data, gyroscopic data, and altitude data received from the wireless device implementing the three-axis accelerometer, the gyroscope, and the altitude sensor;

a database associated with and in communication with the server, the database configured to store the potential fall parameter data of the user, and the database further configured to store a library of previous potential fall parameter data of the user;

the server further configured to analyze the potential fall parameter data to determine whether the potential fall parameter data is consistent with a real fall, wherein the server analyzes the potential fall parameter data and compares the potential fall parameter data comprising the 3-axis acceleration data, the gyroscopic data, and the altitude data to the library of previous potential fall parameter data utilizing artificial intelligence to determine whether the potential fall parameter data is consistent with a real fall;

the server further configured to send an alert to the wireless device if the potential fall parameter data is indicative of a real fall based on the comparison of the potential fall parameter data comprising the 3-axis acceleration data, the gyroscopic data, and the altitude data to the library of previous fall parameter data utilizing the artificial intelligence;

the server further configured to receive an indication from the wireless device in response to the alert, wherein the indication includes an indication that the potential fall parameter data was one of the following: a real fall or a false positive;

the server further configured to receive a location of the user from the wireless device; and the server further configured to transmit the location of the user and the potential fall parameter data to emergency medical services, wherein the server communicates to the wireless device over a wireless network that comprises a wireless mobile telecommunications network;

wherein the server is configured to estimate the location of the wireless device based on a global navigation satellite system; and wherein the server analyzes the potential fall parameter data comprising the 3-axis acceleration data, the gyroscopic data, and the altitude data and compares the potential fall parameter data to the library of previous fall parameter data comprising previous detected fall events, subsequent outcomes of the previous fall events that include an associated response by the user for each of the previous potential fall parameter data, various detected accelerations, and whether the potential fall was a fall event, a non-fall event, a false positive, or a false negative;

the wireless device, and the wireless device comprises a smartphone that comprises:

a fall detection unit configured to generate the potential fall parameter data;

the fall detection device implementing the three-axis accelerometer, the gyroscope, and the altitude sensor to obtain the potential fall parameter data;

a transceiver configured to transmit potential fall parameter data comprising the 3-axis acceleration data, the gyroscopic data, and the altitude data over the wireless mobile telecommunications network to the server;

an output device configured to receive and output the alert in at least one of the following: a graphical user interface and an audio output device;

an input device configured to receive an input response from the user, the input device comprising at least one of the following: a touchscreen graphical user interface implemented by the smartphone and an audio input device implemented by the smartphone configured to receive verbal input; and at least one analog-to-digital converter and at least one filter configured to process signals associated with the three-axis accelerometer, the gyroscope, and the altitude sensor to obtain the potential fall parameter data, wherein the smartphone implements a fall detection application downloaded from an application store.

* * * * *